United States Patent [19]

Nikitas

[11] 4,110,716

[45] Aug. 29, 1978

[54] D.C. BLOCK CONNECTORS

[76] Inventor: Nick C. Nikitas, 41 Choate St., Danvers, Mass. 01923

[21] Appl. No.: 737,478

[22] Filed: Nov. 1, 1976

[51] Int. Cl.[2] ..... H01P 1/00; H01R 5/00

[52] U.S. Cl. ..... 333/97 R; 174/88 C

[58] Field of Search ..... 333/97 R, 24 C; 361/302, 306; 339/48; 174/8.8 C; 308/163

[56] References Cited

U.S. PATENT DOCUMENTS 3,870,978 3/1975 Dreyer ..... 333/97 R

FOREIGN PATENT DOCUMENTS 881,815 7/1953 Fed. Rep. of Germany ..... 174/88 C

OTHER PUBLICATIONS

Heinmann, Henrich, "Which Stamped Retaining Ring?", *Product Engineering,* Feb. 1950, pp. 124–127.

*Primary Examiner*—Alfred E. Smith
*Assistant Examiner*—T. N. Grigsby
*Attorney, Agent, or Firm*—Maurice R. Boiteau

[57] ABSTRACT

There is disclosed in the present application a co-axial connector for very high frequency microwave applications including a ceramic capacitor connected in series between aligned inner conductors by cup-shaped spring washers interposed between each side of the capacitor and the adjacent end of the inner conductor.

8 Claims, 4 Drawing Figures

D.C. BLOCK CONNECTORS

The present invention relates generally to improvements in co-axial connectors for microwave applications and more particularly to such connectors including a D.C. blocking capacitor inserted in the inner conductor.

Heretofore, D.C. blocks have been either external of the connector or built into the connector but both have suffered from a number of deficiencies. In the case of external blocks, they have largely been both expensive and have occupied considerable space where it is often at a very great premium. Neither have attempts to build D.C. blocks into flange-mounted connectors at the microwave energy source been entirely successful. In the case of built-in D.C. blocks to which the present invention more particularly relates, difficulties have arisen in making and maintaining reliable contact between the inner conductor and the D.C. block in the form of a ceramic capacitor which in the case of SMA series connectors is a ceramic chip approximately 1/16 inch square by 1/32 inch thick. Since metallizing the capacitor and soldering have proved both expensive and unreliable, othr expedients have been tried for making contact between the internal conductor and the ceramic capacitor. One of these has been a quantity of metal-filled electrically-conductive silicone compound inserted between the capacitor and the inner conductor. However, probably because of instability in the environment in which D.C. blocks are employed and the stringent testing which they must accordingly undergo, such D.C. blocks have not been adeqate. There have been failures to maintain contact and there have also been short circuits across the ceramic capacitor possibly due to the silicone compound which is placed on both sides of the ceramic capacitor and may flow at elevated temperatures. In addition, such D.C. blocks tend to lack uniformity in their electrical characteristics and are sometimes inefficient because of high insertion losses.

The successful solution of the contact problem in D.C. block connectors is made more difficult because the whole assembly is to be used for very high frequency microwave energy applications and as such must be adapted to passing very stringent electrical and physical tests to assure its reliability after installation. Among the electrical parameters are a low resistance between the inner conductor and the capacitor which must be maintained under conditions of extreme temperature variations typically between minus 65° and plus 125° C. Another and very important electrical characteristic is a low voltage standing wave ratio, generally abbreviated VSWR which should have an acceptably low value over an extended frequency range. In addition, it is necessary that the whole assembly be capable of withstanding relatively substantial forces both before and after exposure to side temperature variations within the range without displacement of the parts and that the means taken to assure physical integrity must not interfere with or modify electrical characteristics nor provide a path for the leakage of electrical energy.

It is accordingly a specific object of the present invention to provide a co-axial connector with a built-in D.C. block having reliable and durable contacts between the inner ends of the inner conductor and the capacitor.

Another object is to improve the resistance of connectors to radial and axial loads and a broad range of environmental temperatures.

Still another object is to improve the reliability and stability of miniature co-axial microwave connectors including those with a built-in D.C. block.

The foregoing objects are achieved according to the present invention by a co-axial connector in which a ceramic capacitor is inserted in series in the inner conductor. For this purpose, according to a feature of the invention, the inner conductor is interrupted and formed with flat inner surfaces adjacent the capacitor. Interposed between each inner surface and the adjacent surface of the capacitor is a cup-shaped spring washer which expands and contracts axially to cushion the capacitor and also to compensate for dimensional variations resulting from changes in temperature.

According to other related features, the component parts of the connector comprising, in addition to the inner conductor, a conductive shell and an insulator are formed and assembled to resist axial and radial loads without adversely effecting the electrical characteristics of the asembly. For this purpose, for example, the shell is formed with a shallow thread, really two threads one right and one left hand, and the insulator is formed with low longitudinal splines in a slightly depressed central area. The thread in the shell and the space between the splines in the insulator provide effective anchors for cement which holds the insulator within the shell.

The foregoing objects and features together with many advantages of the present invention will be more fully appreciated from the followin detailed description of an illustrative embodiment taken in connection with the accompanying drawings in which.

Figure 1:
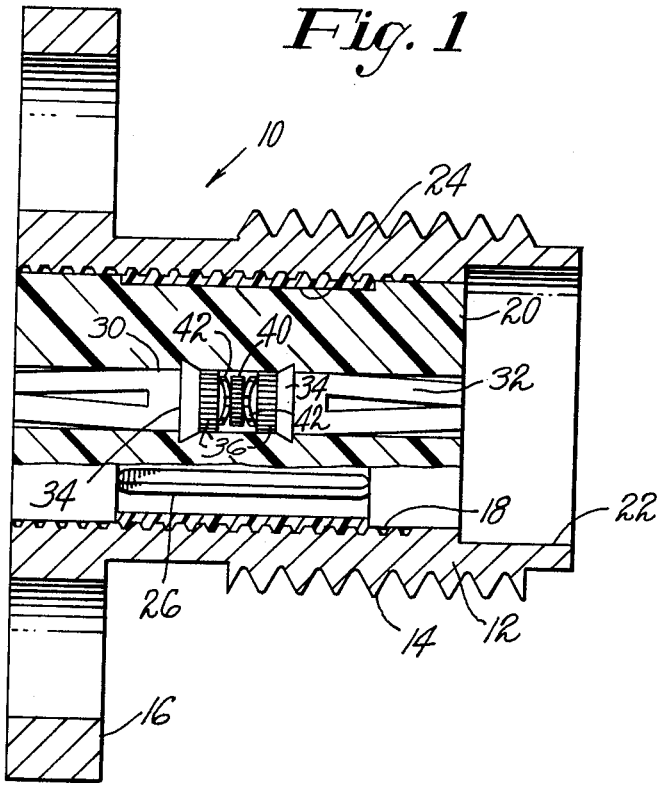
FIG. 1 is a view in longitudinal cross-section of a connector with a built-in D.C. block according to the present invention.
Figure 2:
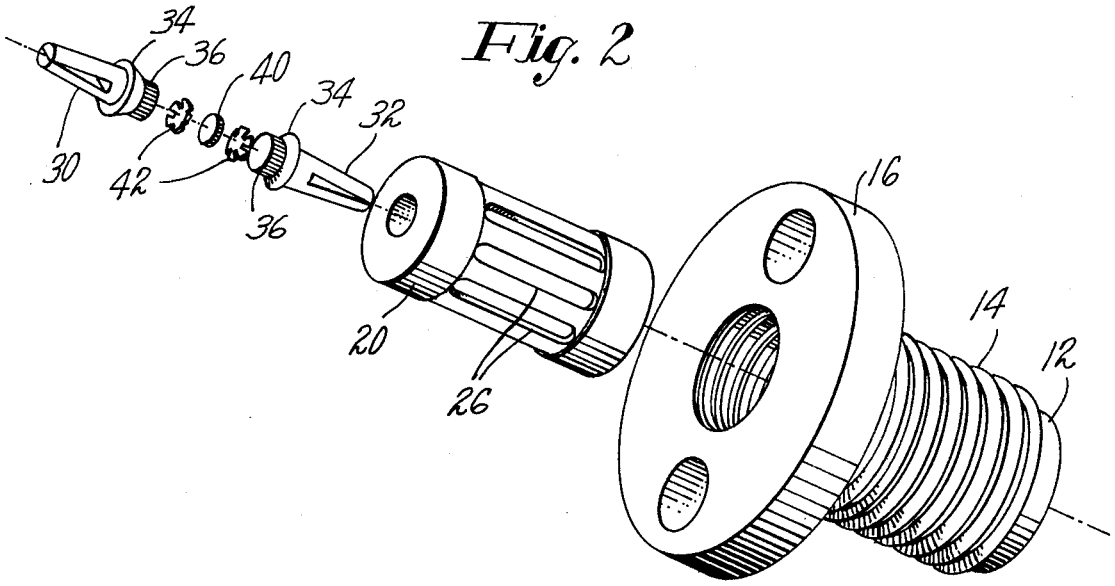
FIG. 2 is a view in perspectiveshowing the connector of FIG. 1 with the component parts depicted in exploded relationship.
Figure 3:
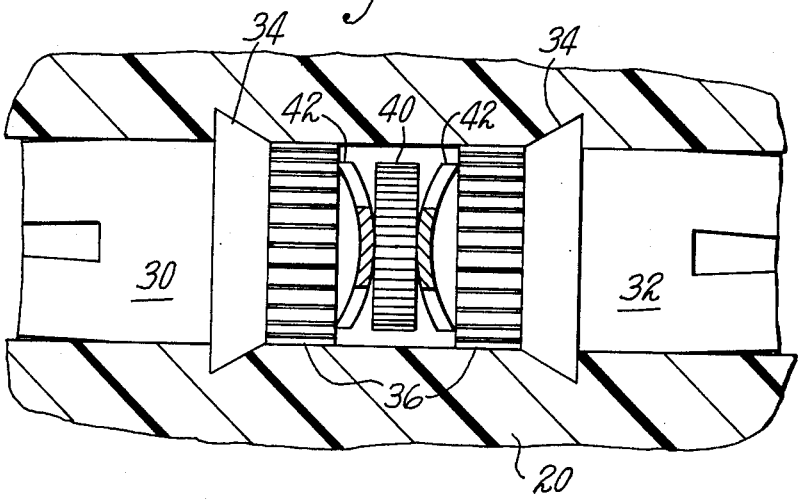
FIG. 3 is a view on an enlarged scale depicting contacts between the ends of the inner conductor and the ceramic capacitor in the connector of FIG. 1.

Turning now to the drawings, particularly FIGS. 1 to 3, there is shown a co-axial connector according to the present invention, indicated generally at 10 and comprising a shell or body 12 threaded at 14 to receive a mating connector member and formed with a flange 16 for securement typically to a housing for the microwave energy source. The interior of the shell 12 is formed with shallow threads represented at 18 and being actually two threads one right hand and one left hand running nearly the entire length of a bore which receives an insulator 20. At its outer end, the shell 12 is formed with a counterbore 22 to accommodate the mating connector. The insulator 20 is sized at its ends to fit the interior of the shell 12 but its central portion is of a slightly reduced diameter 24 formed with shallow longitudinal splines 26 as best seen in FIG. 3. Into the void provided by the reduced diameter 24 and the threads 18, there is introduced a quantity of cement, typically an epoxy resin, which is anchored to resist both torque and logitudinal forces by entering the threads and the space between the splines 26.

A pair of aligned inner conductors 30 and 32 are fixedly mounted in the insulator 20 and each is formed with an annular barb 34 to resist axial forces and a splined end portion 36 to resist torque loads. A ceramic capacitor 40 is mounted between the ends of the inner conductors 30 and 32 and is in electrical contact with them through sprig washers 42 interposed between the flat inner surfaces of the conductors 30 or 32 and the adjacent surface of the capacitor 40. Each spring washer 42 is preferably of beryllium copper 0.003 inch thick and 0.046 inch diameter. Each washer is formed with six equally spaced radial slots 0.008 inch wide and 0.025 inch apart at their inner ends. Each washer is dished 0.010 inch and positioned with its concave surface in contact with the capacitor 40. The washers are thus adapted after a slight installation preload to be compressed or flattened to the extent of substantially their entire convexity. Uniformity of contact from one connector to the next is assured by manufacturing the insulators 20, the conductors 30 and 32, the capacitors 40, and the spring washers 42 to very close dimensional tolerances and assembling the components precisely with control provided by appropriate jigs.

Figure 4:
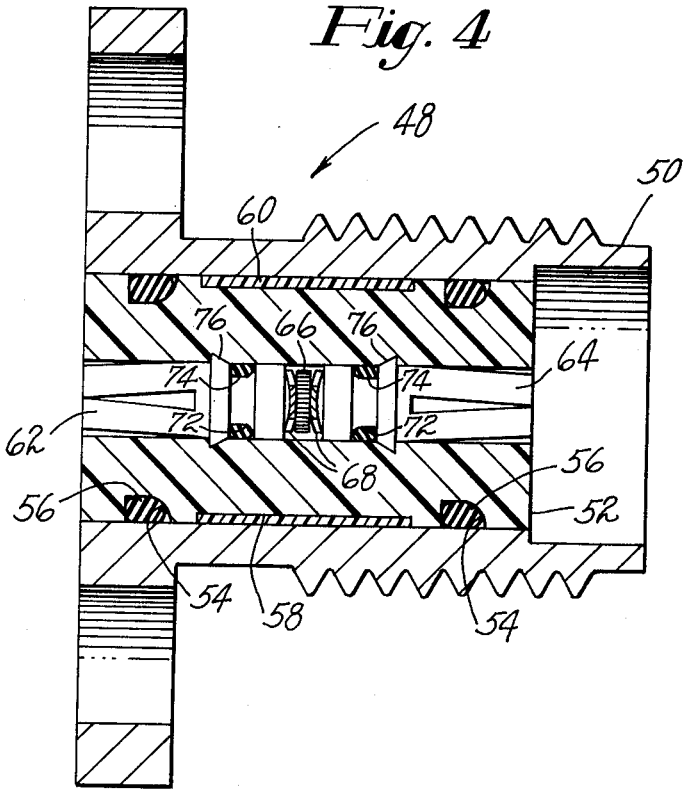
FIG. 4 is a view in longitudinal cross-section of a hermetically sealed alternative construction also according to the present invention.

There is shown in FIG. 4 a connector 48 includng the features just described with respect to the connector 10 but also hermetically sealed for application where such is appropriate. The connector 48 comprises a flanged, counterbored, and externally threaded shell 50 correspondig in external size and function to the shell 12. Inside the shell 50 is an insulator 52 corresponding to the insulator 20 but formed with a pair of annular J-grooves 54 each adapted to receive an O ring 56. The grooves 54 are formed with a curved surface to the right to accommodate the cross-section of the O ring and a flat surface to the left to permit the introduction of the insulator 52 into the shell 50 from left to right without camming the O ring of the groove an thus subjecting it to damage. It will also be noted that the interior of the shell 50 is not threaded in order to avoid damage to the O rings 56 during installation. However, the centrl portion of the insulator 52 is of a reduced diameter 58 formed with splines corresponding to the splines 26 but not shown and a quantity of cement 60 is used in the reduced diameter 58 to bond the insulator 52 to the shell 50. In addition, the pressure of the slightly compressed O rings 56 against the bottom of the groove 54 and the interior of the shell 50 assists in resisting torque and axial forces.

A pair of inner conductors 62 and 64 are mounted in the insulator 52 in much the same manner as the conductors 30 and 32 in the insulator 20 and have between them a capacitor 66 to which electrical contact is established by spring washers 68. Each of the conductors 62 and 64 is formed with a J-groove 72 to accommodate and O ring 74 and with an annular barb 76 to resist displacement under axial forces. As in the case of the O ring 56, the O rings 74 also assits in resisting forces which tend to dislodge the inner conductors 62 and 64 from the insulator 52. The O rings 56 and 74 prevent the passage of fluid respectively at the interior of the shell 50 and of the insulator 52 typically from the flange end of the connector to the counterbored end.

Having thus disclosed my invention what I claim as new and desired to secure by Letters Patent of the United States is:

1. A D.C. block connector for microwave applications comprising an outer conductive shell, a pair of aligned inner conductors each formed with a flat inner end and mounted co-axially with the shell, an insulator between the shell and the inner conductors fixedly retained in the shell and formed with a longitudinal perforation into which the inner conductors are interference fitted and secured with their inner ends in facing relation, a ceramic capacitor smaller than the ends of the inner conductors, mounted in the perforation between the inner ends of the conductors and an axially compressible electrically conductive spring member loosely fitted in the perforation between the capacitor and the end surface of the adjacent inner conductor.

2. A connector according to claim 1 further characterized in that the members are dished and that each is positioned with its convex surface in contact with the capacitor.

3. A connector according to claim 2 further characterized in that each spring member is formed of beryllium copper and with a plurality of radial slots.

4. A connector according to claim 1 further characterized in that the outer shell is internally roughened, that the insulator is formed with exterior longitudinal splines and that a quantity of cement is inserted into the void defined by the interior roughening and the splines on the insulator.

5. A connector according to claim 4 further characterized in that the spring members are dished and that each is positioned with its convex surface in contact with the capacitor.

6. A connector according to claim 5 further characterized in that each spring member is formed of beryllium copper and with a plurality of radial slots.

7. A connector according to claim 1 further characterized in that each of the inner conductors is formed with an annular retaining barb and a splined end portion anchored in the insulator.

8. A connector according to claim 1 further comprising hermetic seals between the shell and the insulator and between the insulator and the inner conductors.

* * * * *